US011480897B2

(12) United States Patent
Hayashi et al.

(10) Patent No.: US 11,480,897 B2
(45) Date of Patent: Oct. 25, 2022

(54) IMAGE FORMING APPARATUS WITH GUIDING SURFACES FORMED OF METAL AND RESIN FOR IMPROVED RESISTANCE TO WATER VAPOR CONDENSATION

(71) Applicant: CANON KABUSHIKI KAISHA, Tokyo (JP)

(72) Inventors: Hideki Hayashi, Saitama (JP); Atsushi Yoshida, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/320,141

(22) Filed: May 13, 2021

(65) Prior Publication Data

US 2021/0373467 A1 Dec. 2, 2021

(30) Foreign Application Priority Data

Jun. 1, 2020 (JP) ..... JP2020-095409

(51) Int. Cl.
*G03G 15/20* (2006.01)
*B65H 85/00* (2006.01)
*B65H 29/12* (2006.01)

(52) U.S. Cl.
CPC ..... *G03G 15/2028* (2013.01); *B65H 29/12* (2013.01); *B65H 85/00* (2013.01)

(58) Field of Classification Search
USPC ..... 399/322, 401
See application file for complete search history.

(56) References Cited

U.S. PATENT DOCUMENTS 10,983,472 B2 4/2021 Inoue et al. ..... G03G 15/6555
2015/0117926 A1* 4/2015 Iino ..... G03G 15/6529 399/401
2021/0072699 A1 3/2021 Inoue et al. ..... G03G 15/6582

FOREIGN PATENT DOCUMENTS

CN 102902176 A * 1/2013 ..... B65H 5/38
JP 2009-145469 7/2009

* cited by examiner

*Primary Examiner* — Quana Grainger
(74) *Attorney, Agent, or Firm* — Venable LLP

(57) ABSTRACT

An image forming apparatus includes a fixing unit, a first guiding unit having a first surface forming a first feeding passage, and a second guiding unit forming a second feeding passage. The second guiding unit includes a first member made of metal and having a first guiding surface on which a leading end of a sheet is guided in a first section including an upstream end portion of the second feeding passage with respect to a sheet feeding direction, and includes a second member made of a resin material and having a second guiding surface on which the sheet is guided in a second section downstream of the first section in the second feeding passage with respect to the sheet feeding direction. The first guiding surface is spaced from a first phantom contact surface extending from an end portion of the first surface and contacting the second guiding surface.

10 Claims, 11 Drawing Sheets

IMAGE FORMING APPARATUS WITH GUIDING SURFACES FORMED OF METAL AND RESIN FOR IMPROVED RESISTANCE TO WATER VAPOR CONDENSATION

FIELD OF THE INVENTION AND RELATED ART

The present invention relates to an image forming apparatus.

In the image forming apparatus such as a printer, a water content becomes water vapor due to heating during a fixing process in which an unfixed toner image is fixed on a sheet by heating the sheet, and stagnates in a feeding passage in some cases. In such a case dew condensation occurs on the feeding passage by stagnation of the water vapor in some cases, so that image defect and improper feeding occur by contact of condensed water with the sheet. Further, the image defect also occurs by contact of the sheet with paper powder accumulated in the feeding passage. On the other hand, in Japanese Laid-Open Patent Application 2009-145469, a constitution in which a feeding guide forming the feeding passage is provided with an auxiliary member made of a fluorine-containing resin material for alleviating a degree of friction with the sheet is disposed. By this, the sheet is fed on the auxiliary member, and therefore, contact of the condensed water (content) or the paper dust with the sheet is suppressed. In recent years, improvement in productivity of the apparatus by increasing a feeding speed of the sheet high in rigidity, such as a business card, a postcard, or the like has been required. In this case, when a leading end of the sheet high in rigidity abuts against the auxiliary member, there is a liability that a surface of the auxiliary member is abraded and worn. As a result, the sheet contacts the condensed water (content) and the paper dust, so that the image defect and the improper feeding occur.

SUMMARY OF THE INVENTION

A principal object of the present invention is to provide an image forming apparatus capable of suppressing image defect and improper feeding due to dew condensation on a feeding passage when a sheet on which a toner image is heated and fixed passes through the feeding passage.

According to an aspect of the present invention, there is provided an image forming apparatus comprising: fixing means configured to heat and fix a toner image on a sheet; a first guiding unit having a first surface forming a first feeding passage along which the sheet on which the toner image is fixed by the fixing means is fed; and a second guiding unit provided downstream of and adjacent to the first guiding unit with respect to a sheet feeding direction and configured to form a second feeding passage along which the sheet fed along the first feeding passage is fed, wherein the second guiding unit includes a first member which is made of metal and which has a first guiding surface on which a leading end of the sheet is guided in a first section including an upstream end portion of the second feeding passage with respect to the sheet feeding direction, and includes a second member which is made of a resin material and which has a second guiding surface on which the sheet is guided in a second section downstream of the first section in the second feeding passage with respect to the sheet feeding direction, and wherein the first guiding surface is spaced from a first phantom contact surface which is a contact surface extending from an end portion of the first surface and contacting the second guiding surface.

According to another aspect of the present invention, there is provided an image forming apparatus comprising: fixing means configured to heat and fix a toner image on a sheet; a first guiding portion having a first surface forming a first feeding passage along which the sheet on which the toner image is fixed by the fixing means is fed; and a second guiding portion provided downstream of and adjacent to the first guiding portion with respect to a sheet feeding direction and configured to have a curved shape so as to form a second feeding passage along which the sheet fed along the first feeding passage is fed, wherein the second guiding portion includes a first member which is made of metal and which has a first guiding surface on which a leading end of the sheet is guided in a first section including an upstream end portion of the second feeding passage with respect to the sheet feeding direction, and includes a second member which is made of a resin material and which has a second guiding surface on which the sheet is guided in a second section downstream of the first section in the second feeding passage with respect to the sheet feeding direction, and wherein an upstream end portion of the second guiding surface with respect to the sheet feeding direction is positioned downstream, with respect to the sheet feeding direction, of a position where a first phantom surface extended from the first surface and the first guiding surface cross each other.

Further features of the present invention will become apparent from the following description of exemplary embodiments with reference to the attached drawings.

DESCRIPTION OF THE EMBODIMENTS

In the following, embodiments for carrying out the present invention will be described with reference to the drawings.

Embodiment 1

<General Structure of Image Forming Apparatus>

Figure 1:
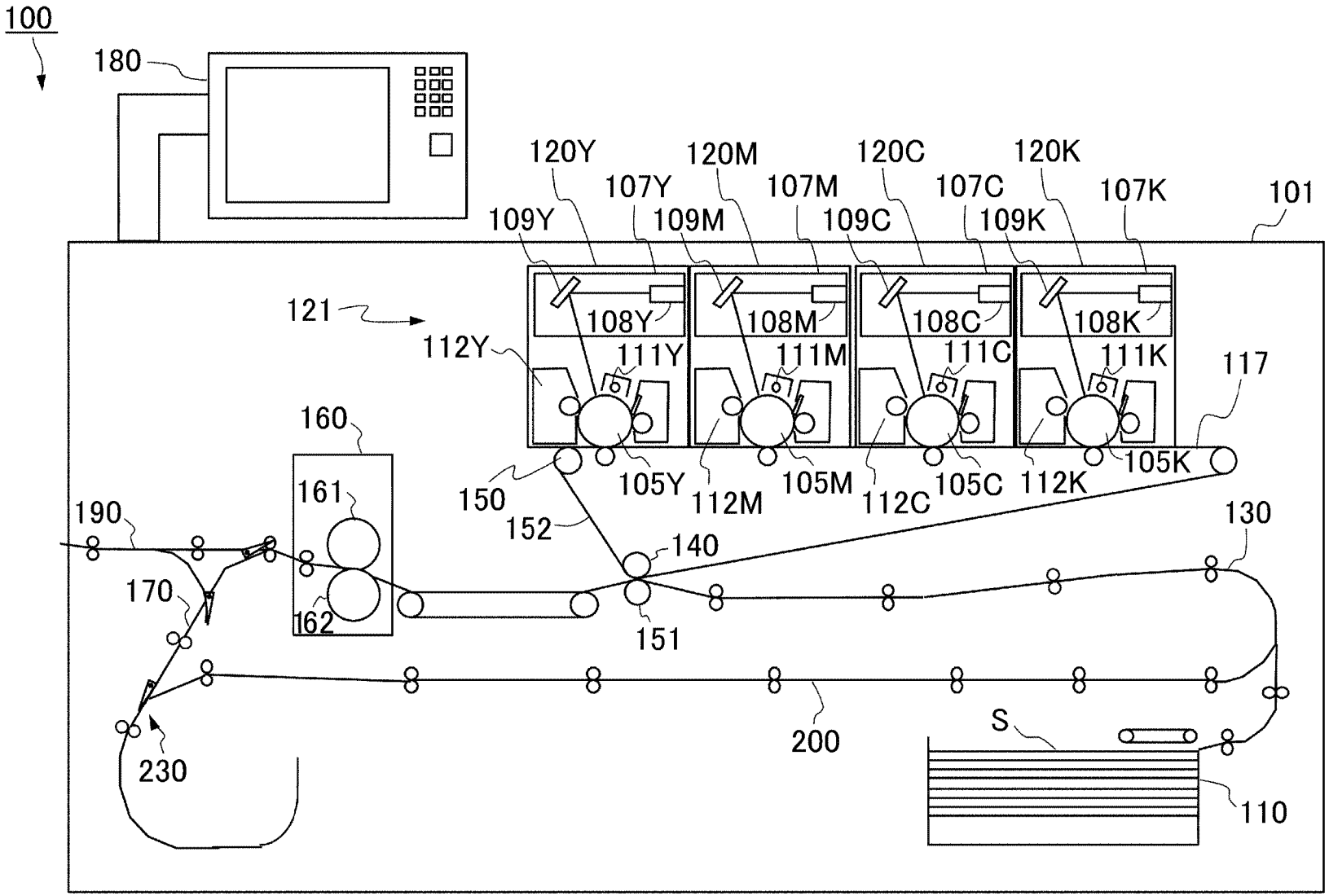
FIG. 1 is a schematic structural view of a printer of an embodiment 1.

First, structures of a sheet feeding device and a printer 100 as an image forming apparatus of an embodiment 1 will be described with reference to FIG. 1. FIG. 1 is a schematic structural view of the printer 100. The printer 100 includes a casing 101. Further, the printer 100 includes an engine portion 121 as an image forming means, a fixing portion 160 as a fixing means for heating and fixing a toner image on a sheet S, a feeding portion 110 for feeding the sheet S, a conveying portion 130 for conveying the sheet S, and a double-side feeding (conveying) portion 200 (feeding portion for double-side printing). Further, the printer 100 includes an operating portion 180 operated by a user for executing an image forming process and for various settings.

The engine portion 121 of FIG. 1 includes a yellow (Y) station 120Y, a magenta (M) station 120M, a cyan (C) station 120C, and a black (K) station 120K, and is constituted so as to be capable of outputting a full-color image. As regards the Y station 120Y, the M station 120M, the C station 120C and the K station 120K, a common structure is employed except that colors of toners are different from each other. In this embodiment, a structure of the Y station 120Y, will be described as an example. Incidentally, in FIG. 1, YMCK are distinguished by adding these alphabets to the ends of reference numerals. The Y station 120Y includes a laser scanner portion 107Y, a photosensitive drum 105Y, a primary charger 111Y, and a developing device 112Y. In the Y station 120Y, depending on image data supplied from a controller, the photosensitive drum 105Y is irradiated with laser light emitted from a laser scanner portion 107. The laser scanner portion 107Y causes a semiconductor laser 108Y to emit the laser light so as to be reflected by a reflection mirror 109Y and then to irradiate the photosensitive drum 105Y with the laser light. A surface of the photosensitive drum 105Y is electrically charged in advance by the primary charger 111 so as to assume a uniform electric charge. Further, by the laser light emitted from the laser scanner portion 107Y, the surface of the photosensitive drum 105Y is exposed to light, so that an electrostatic latent image depending on image data is formed. The electrostatic latent image formed on the surface of the photosensitive drum 105Y is visualized into a toner image by the developing device 112Y. Then, the toner image on the surface of the photosensitive drum 105Y is transferred (primary-transferred) onto an intermediary transfer member 152 capable of carrying the toner. Thus, onto the intermediary transfer member 152 as an image bearing member, toner images of the colors of YMCK are successively transferred, so that a full-color visible image is formed on the intermediary transfer member 152.

The sheet S fed from the feeding portion 110 is fed by the conveying portion 130 toward a secondary transfer portion including a transfer roller 151 and an inner roller 140 which constitute a transfer means in this embodiment. The visible image formed on the intermediary transfer member 152 is transferred (secondary-transferred) onto the sheet S in the secondary transfer portion. Incidentally, the photosensitive drum 105Y and the developing device 112Y are mountable in and dismountable from the printer 100. In the secondary transfer portion, the sheet S on which the toner image is transferred is fed toward the fixing portion 160. The fixing portion 160 includes a fixing roller 161 for applying heat to the sheet S and a pressing belt 162, and the toner image transferred on the sheet S is fixed on the sheet S by heating and pressing. The fixing roller 161 includes a heater therein and is constituted so that simultaneously with rotational drive thereof, the sheet S is nipped and fed by the fixing roller 161 and the pressing belt 162. The sheet S passed through the fixing portion 160 is guided to a discharge feeding path 190 or a reverse feeding path 170. The sheet S guided to the reverse feeding path 170 is subjected to switch-back at a reverse feeding portion 230. By the switch-back at the reverse feeding portion 230, a state in which a leading end and a trailing end of the sheet S are changed to each other is formed. The reversed sheet S is fed again to the secondary transfer portion through the double-side feeding portion 200, and then the toner image is transferred and fixed on a back surface of the sheet S similarly as in the case of a front surface of the sheet S. As a kind of the sheet S used in the printer 100, there are various kinds from thin paper to thick paper, such as plain paper, recycled paper, glossy paper, coated paper, a plastic sheet such as an OHP sheet, and a postcard and a business card, and the like. For that reason, a constitution in which a fixing temperature at the fixing portion 160 is changeable depending on the kind of the sheet used is employed.

Figure 2:
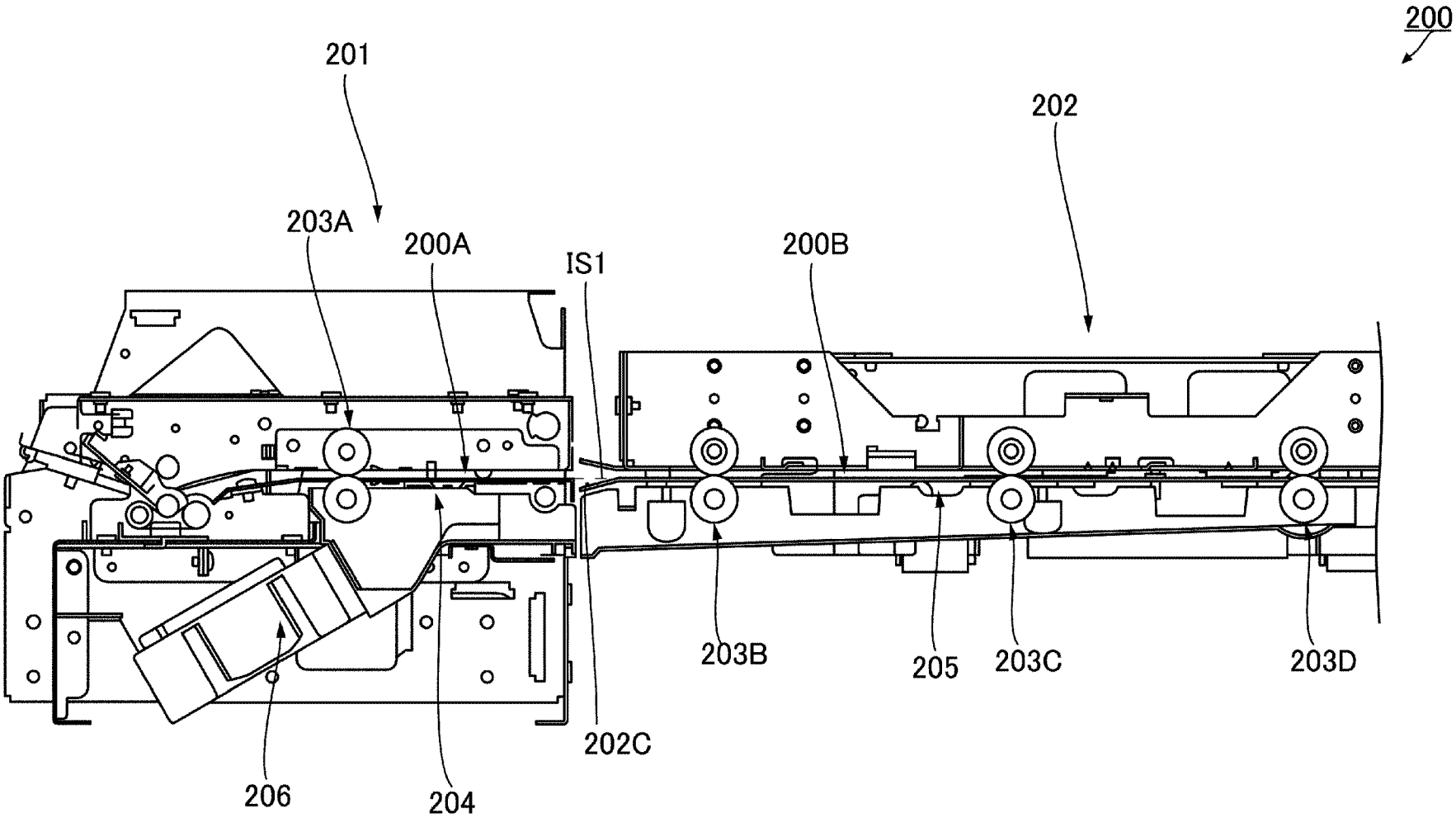
FIG. 2 is a schematic sectional view of a double-side feeding portion in the embodiment 1.
Figure 3:
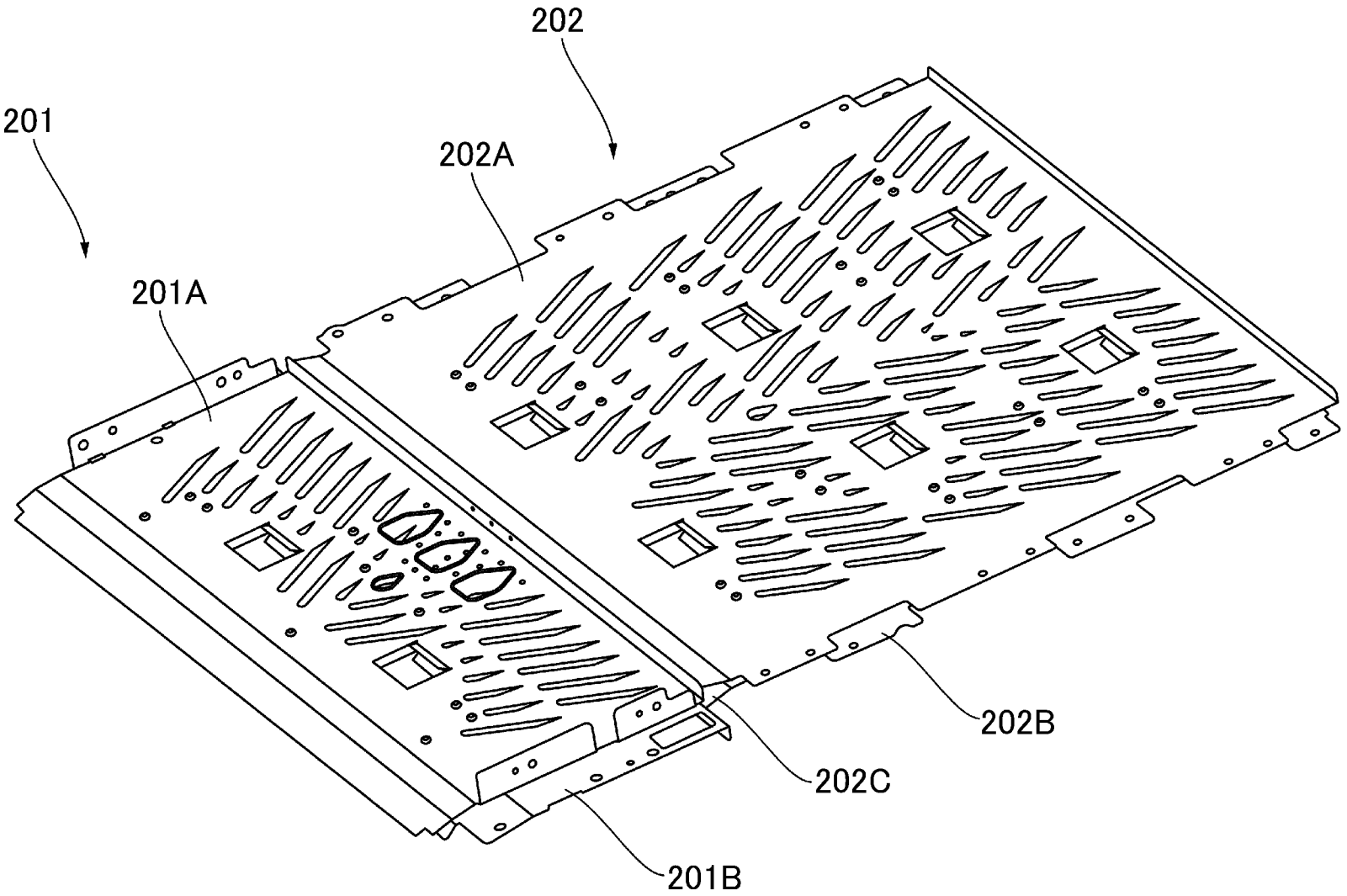
FIG. 3 is a schematic perspective view showing an upper guide and a lower guide which constitute the double-side feeding portion in the embodiment 1.

Next, a specific structure of the double-side feeding portion 200 will be described. FIG. 2 is a schematic sectional view of the double-side feeding portion 200. Further, FIG. 3 is a perspective view showing upper guides 201A and 202A and lower guides 201B and 202B which constitute a feeding passage of the double-side feeding portion 200. The double-side feeding portion 200 includes a first feeding unit 201 forming a feeding passage 200A and a second feeding unit 202 which is provided downstream of and adjacent to the first feeding unit 201 with respect to a sheet feeding direction and which forms a feeding passage 200B. The first feeding unit 201 includes, as shown in FIG. 3, the upper guide 201A and the lower guide 201B which are used for guiding the sheet S, and the feeding passage 200A (FIG. 2) is formed between the upper guide 201A and the lower guide 201B. The second feeding unit 202 includes, as shown in FIG. 3, the upper guide 202A and the lower guide 202B, and the feeding passage 200B (FIG. 2) is defined between the upper guide 202A and the lower guide 202B. The first feeding unit 201 is provided with a feeding roller pair 203A for nipping and feeding the sheet. Further, the second feeding unit 202 is provided with feeding roller pairs 203B, 203C, 203D and 203E (FIG. 6) for nipping and feeding the sheet fed along the feeding passage 200A. The sheet on which the toner image is fixed at the fixing portion 160 (FIG. 1) is sent to the first feeding passage 200A by the reverse feeding portion 230 and then is guided again to the conveying portion 130 (FIG. 1) through the first feeding passage 200A and the second feeding passage 200B. In this embodiment, a first feeding passage is the feeding passage 200A and a second feeding passage is the feeding passage 200B. Further, in this embodiment, a first guiding unit is the first feeding unit 201 and a second guiding unit is the second feeding unit 202.

As shown in FIG. 3, the first feeding unit 201 comprises the upper guide 201A and the lower guide 201B, and each of the upper guide 201A and the lower guide 201B is provided with air vents for permitting passing of the air. Further, the second feeding unit 202 comprises the upper guide 202A and the lower guide 202B, and each of the upper guide 202A and the lower guide 202B is provided with air rents for permitting passing of the air. Further, as shown in FIG. 2, the first feeding unit 201 and the second feeding unit 202 are provided with sensors 204 and 205, respectively, for detecting the sheet.

Figure 4:
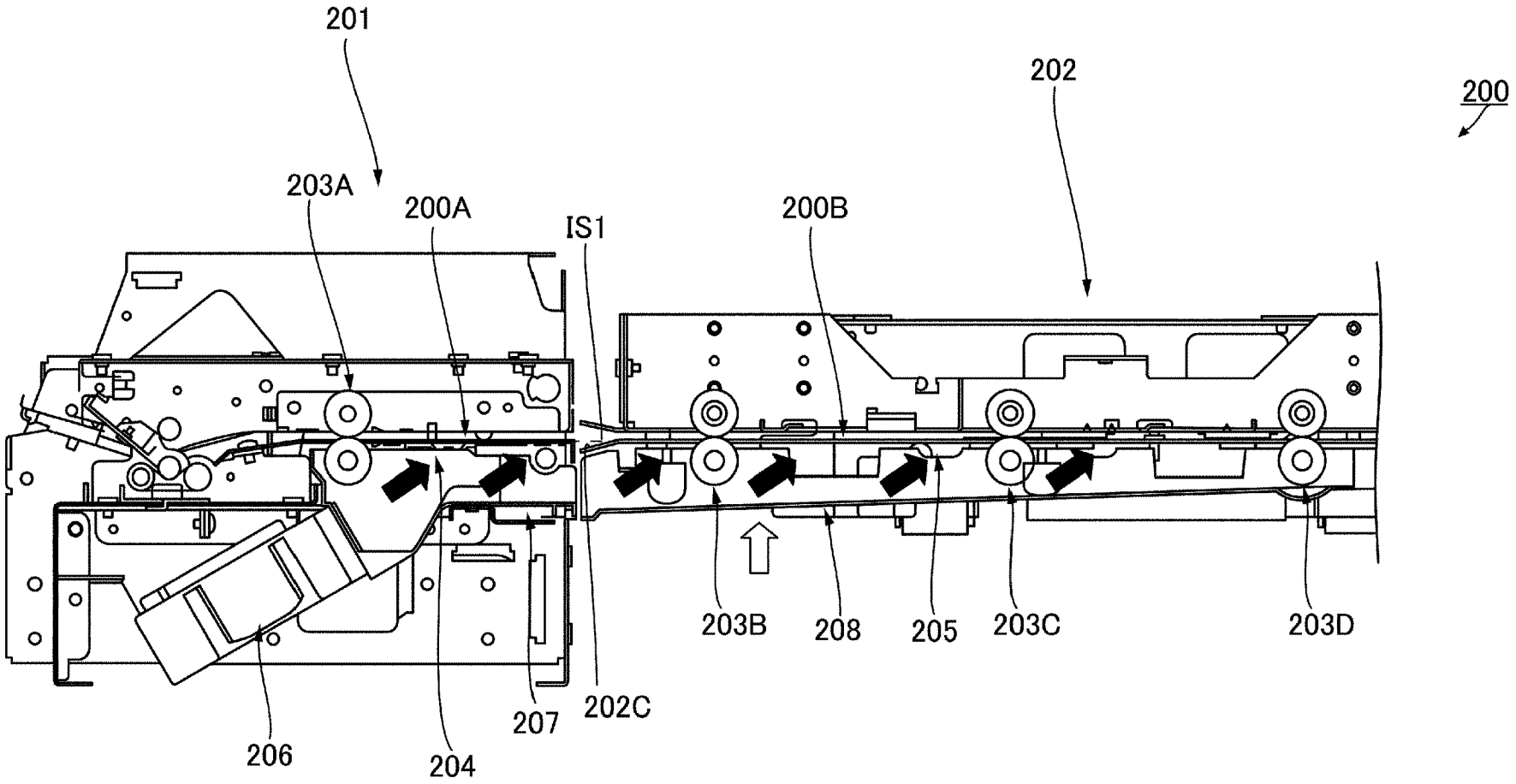
FIG. 4 is a sectional view for illustrating a state of the double-side feeding portion during drive of a fan in the embodiment 1.
Figure 5:
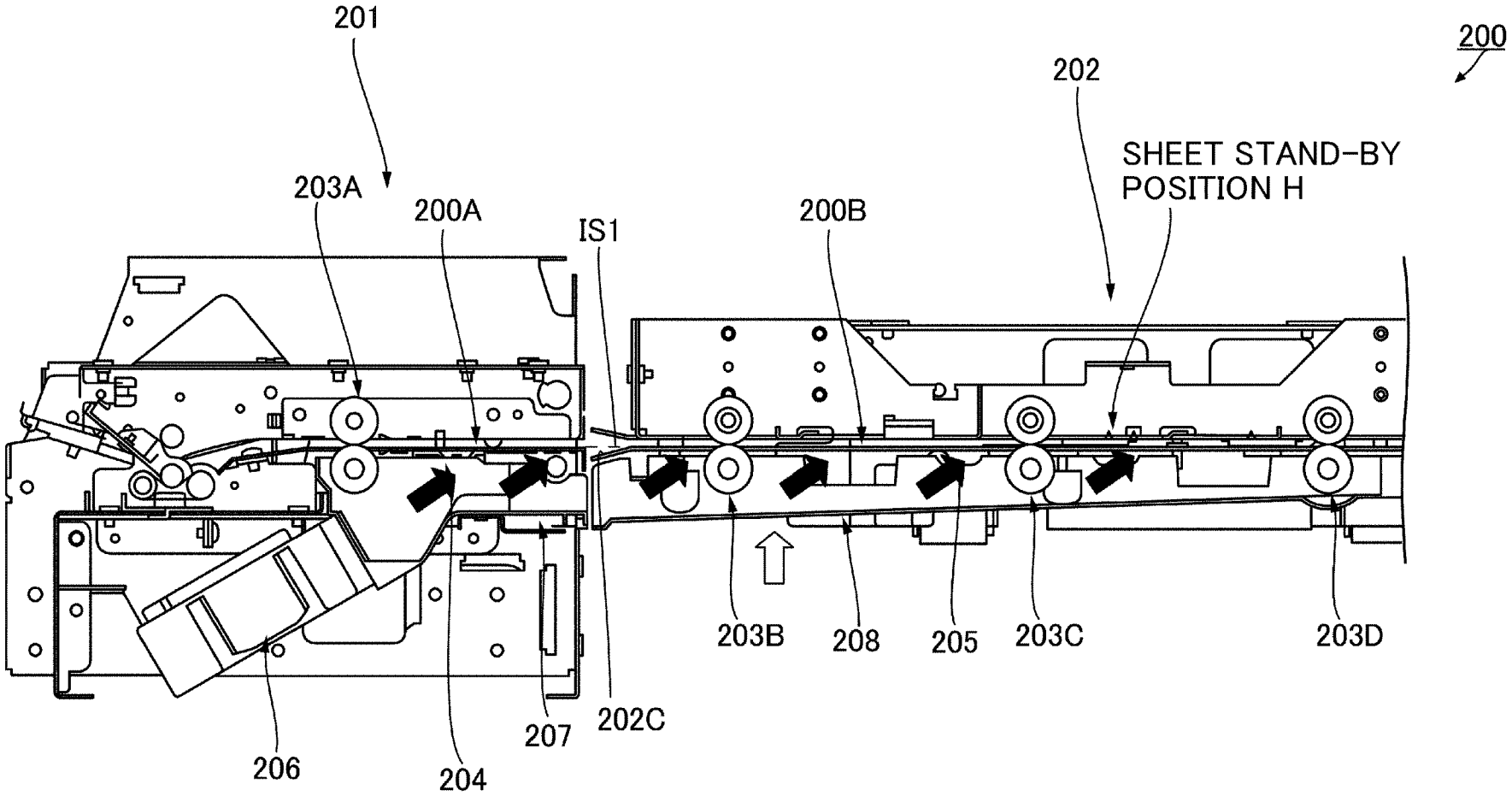
FIG. 5 is a sectional view for illustrating a cooling mode of a sheet during stand-by of the sheet in the sheet in the embodiment 1.

In the printer 100 in this embodiment, in the neighborhood of the first feeding unit 201, a fan 206 for cooling the sheet is provided. The fan 206 is provided with suction opening for sucking the air in the neighborhood of the reverse feeding portion 230, and a discharge opening of the sucked air is formed so that the discharged air flows into the first feeding unit 201 (FIG. 4). FIG. 4 is a sectional view for illustrating a state of the fan 206 during drive of the fan 206 in the double-side feeding portion 200. Further, FIG. 5 is a sectional view for illustrating a cooling mode of the sheet during stand-by of the sheet at the double-side feeding portion 200. When the fan 206 operates, as indicated by arrows in FIGS. 4 and 5, the air in the neighborhood of the reverse feeding portion 230 flows into the feeding passage 200A. As described above, each of the upper guides 201A and 202A and the lower guides 201B and 202B is provided with the air vents, and therefore, water vapor generated during a fixing process at the fixing portion 160 does not readily stagnate in the first feeding unit 201 and the second feeding unit 202.

Incidentally, with respect to the sheet feeding direction, a position of the fan 206 is on a side upstream of the double-side feeding portion 200, i.e., in the neighborhood of the first feeding unit 201, it is possible to efficiently suppress generation of dew condensation onto the double-side feeding portion 200 by water vapor. This is because the water vapor is removed by flowing of the air from the first feeding unit 201 toward the second feeding unit 202 by the fan 206 and thus the dew condensation in the second feeding unit 202 can also be suppressed. Further, as regards cooling of the sheet, a cooling mechanism such as a fan may also be provided in the neighborhood of a sheet stand-by position H (FIG. 5) of the double-side feeding portion 200. In a state in which the feeding of the sheet is at rest, the sheet can be cooled with reliability by blowing the air against the sheet. As shown in FIGS. 4 and 5, on a side downstream of the fan 206 with respect to the sheet feeding direction, a duct 207 and a duct 208 are provided. By such an arrangement, the air discharged from the fan 206 is spread out in both the sheet feeding direction and a widthwise direction perpendicular to the sheet feeding direction, so that the sheet can be cooled efficiently.

Next, a feeding operation until the sheet is fed from the fixing portion 160 to the double-side feeding portion 200 through the reverse feeding portion 230 and then feeding of the sheet with an upward back surface is started, and control of the fan 206 will be described. As shown in FIG. 1, the sheet S guided to the reverse feeding path 170 is subjected to switch-back in the reverse feeding portion 230. The sheet S of which leading end and trailing end are replaced with each other in the reverse feeding portion 230 is fed again toward the secondary transfer portion through the double-side feeding portion 200, and then the toner image is transferred and fixed on the back surface of the sheet S similarly as in the case of the front surface of the sheet S. In the case where the toner images are formed on the double (both) surfaces of the sheet, a feeding timing of the sheet put on stand-by at the sheet stand-by position H (FIG. 5) is adjusted by controlling drive of the feeding roller pairs 203A, 203B, 203C, 203D, and the like which are provided in the double-side feeding portion 200. As regards the sheet put on stand-by at the sheet stand-by position H, the feeding timing thereof is adjusted in synchronism with image formation timing in the engine portion 121 in a state in which an interval between the sheet and a preceding sheet fed by the feeding portion 130 is maintained. The fan 206 is not driven at a time of a start of a printing operation at the engine portion 121, but is constituted so that the drive thereof is started when the sheet enters the reverse feeding portion 230. By this, noise of the printer 100 during the operation of the engine portion 121 can be alleviated. When the sheet is fed to the reverse feeding portion 230, in order to prevent the water vapor to stagnate at the double-side feeding portion 200, the drive of the fan 206 is started. In a state in which the fan 206 is driven, when the sheet is fed by the feeding roller pairs 203A, 203B, and 203C and reaches the sheet stand-by position H, rotations of the feeding roller pairs 203A, 203B, and 203C are stopped. A sheet stand-by time at the sheet stand-by position H varies depending on products. However, for example, in a period in which the absence of the sheet at the feeding portion 110 is detected and the image is subjected to cleaning or in the case where post-processing in a post-processing device connected to the printer 100 is performed, or in the like case, the sheet put on stand-by at the sheet stand-by position H is always cooled by the fan 206. For that reason, in the printer 100, on the basis of output values of the sensors 204 and 205, the sheet stand-by time is detected. Then, in the case where the sheet stand-by time exceeds a time determined in advance, control such that the operation of the fan 206 is stopped or that an air flow rate is lowered is carried out, so that in the printer 100, the influence on formation of the toner image on a second surface (back surface) of the sheet is suppressed.

Figure 6A:
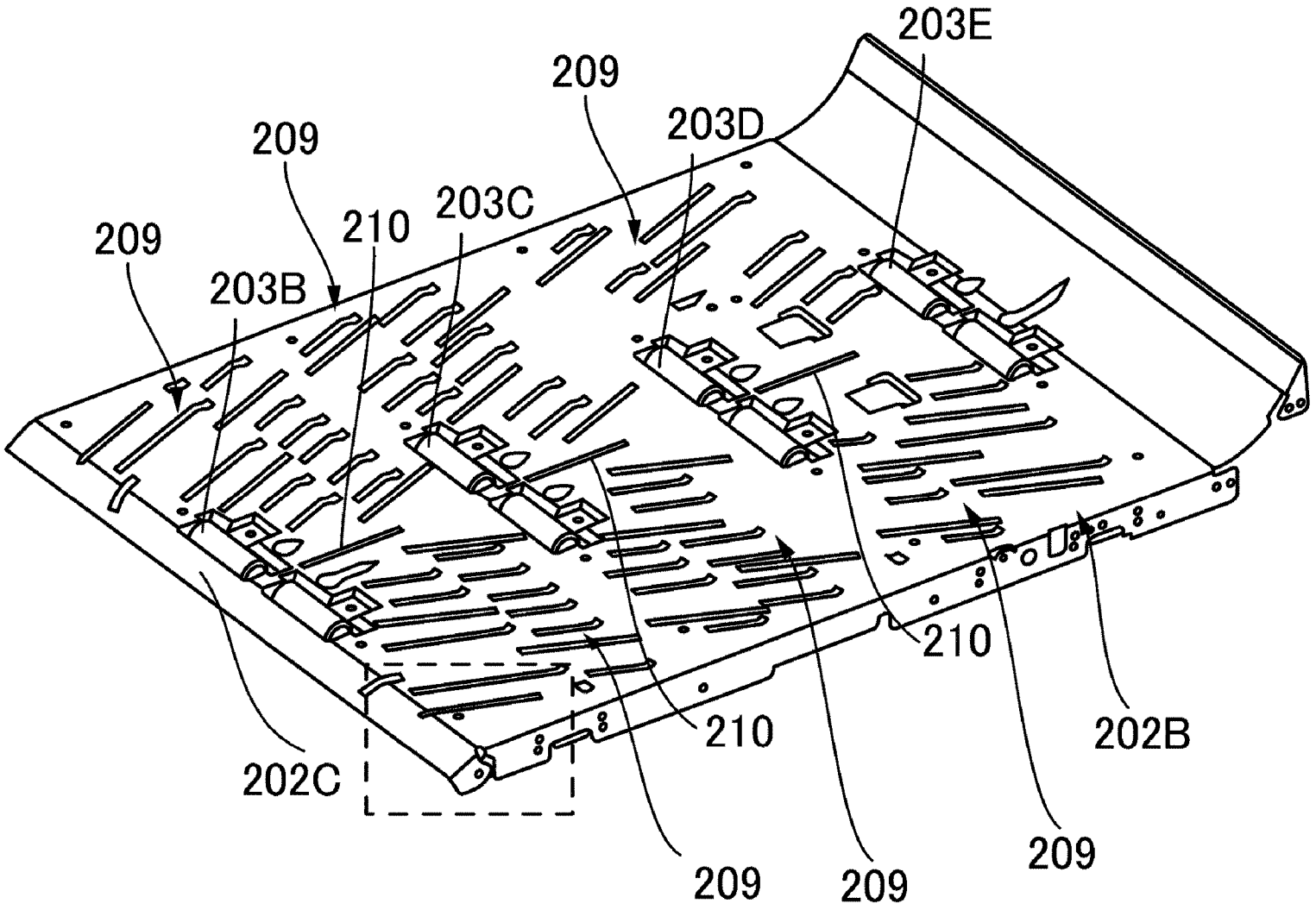
FIG. 6A is a perspective view of a lower guide of a second feeding unit in the embodiment 1.
Figure 6B:
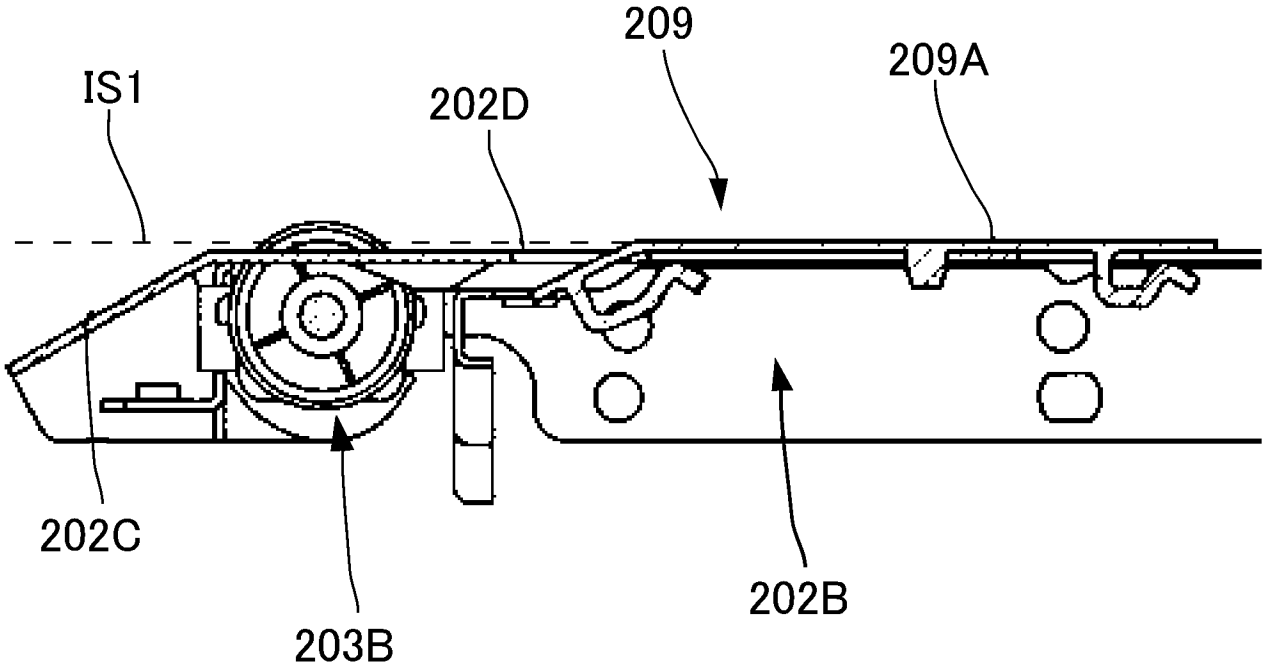
FIG. 6B is a sectional view of the lower guide of the second feeding unit in the embodiment 1.
Figure 6C:
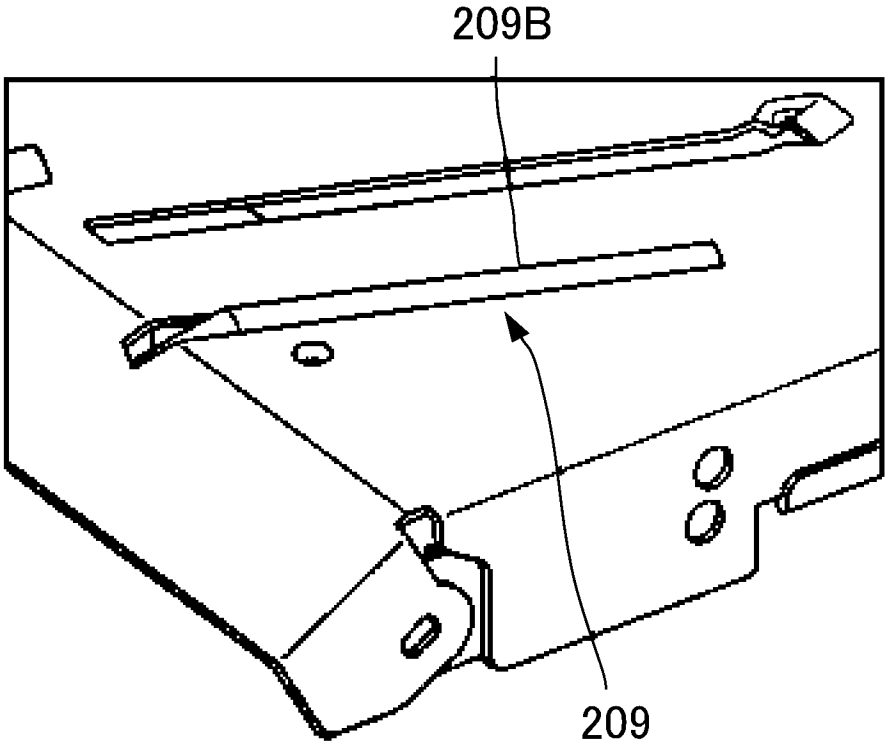
FIG. 6C is an enlarged view of a rib of the lower guide of the second feeding unit in the embodiment 1.

Next, with reference to FIGS. 6A to 6C, ribs 209 and 210 provided on the lower guide 202B will be described. FIG. 6A is a perspective view of the lower guide 202B. FIG. 6B is a sectional view of the lower guide 202B. FIG. 6C is an enlarged view of the rib 209. As described above, in the printer 100, the dew condensation in the feeding passages 200A and 200B is suppressed by diffusing the water vapor by the fan 206. However, depending on a use (operation) environment of the printer 100 or a water content of the sheet, the water vapor stagnates in the second feeding unit 202 and causes slight dew condensation in some cases.

As regards such influence of the water vapor, in this embodiment, as shown in FIG. 6A to 6C, the lower guide 202B is made of a metal material such as stainless steel or aluminum and then is provided with the ribs 209 on the surface thereof on a feeding passage 200B side. That is, the lower guide 202B as a first member which is a plate-like member made of metal high in thermal conductivity and high in hardness is provided with the ribs 209 as a second member made of a resin material such as polyacetal (POM) lower in thermal conductivity and rigidity than the lower guide 202B. By doing so, the water vapor stagnating in the feeding passage 200B of the second feeding unit 202 causes the dew condensation on the surface of the lower guide 202B and does not readily cause the dew condensation on the surfaces of the ribs 209. As shown in FIG. 6B, the ribs 209 have a shape such that the ribs 209 project toward the feeding passage 200B than the surface of the lower guide 202B is, so that the sheet is guided along free end portions 209A of the ribs 209. In this embodiment, a projected portion and a first projected portion are the ribs 209, and a second guiding surface is the free end portions 209A. Therefore, in this embodiment, even in the case where the printer 100 is in an environment in which the printer 100 is liable to cause the dew condensation, the sheet can be fed in a state in which the sheet does not readily contact the surface of the lower guide 202B on which the dew condensation occurs. Accordingly, in the second feeding unit 202 in this embodiment, it becomes possible to suppress image defect and improper feeding of the sheet. Further, by disposing the ribs 209, a gap is formed between the lower guide 202B and the sheet, so that an air bent property in the second feeding unit 202 is improved, and therefore, an effect such that the dew condensation does not more readily occur is also achieved.

Further, in the feeding passage 200B, the sheet is fed along the lower guide 202B side by its own weight. For that reason, although the ribs 209 may desirably be disposed on the lower guide 202B, the ribs 209 may also be disposed on the upper guide 202A (FIG. 3). Further, in FIGS. 6A and 6C, as the ribs 206, those shaped so that the ribs 209 which are inclined from a feeding center toward outsides with respect to the widthwise direction of the sheet and which extend outward toward a downstream side of the sheet feeding direction are shown. By disposing such-shaped ribs 209 outsides the feeding roller pairs 202B, 203C, 203D, and 203E with respect to the widthwise direction, it is possible to suppress that an end portion of the sheet is caught by the ribs 209. Incidentally, the ribs 209 may also be shaped so as to extend in the sheet feeding direction.

Further, ribs 210 as a second member shaped so as to extend in the sheet feeding direction may also be provided at positions overlapping the feeding roller pairs 203B and 203C with respect to the widthwise direction and between the feeding roller pairs 203B and 203C. The ribs 210 have a shape such that the ribs 210 project toward the feeding passage 200B than the surface of the lower guide 202B is, similarly as in the case of the ribs 209. In this embodiment, a second projected portion is the rib 210. Further, with respect to the sheet feeding direction, the position where the rib 210 is provided is not limited to the position between the feeding roller pairs 203B and 203C. The rib 210 can be provided between two roller pairs, of the feeding roller pairs 203B, 203C, 203D, and 203E, which are disposed adjacent to each other with respect to the sheet feeding direction. That is, in the feeding roller pairs 203B, 203C, 203D, and 203E as roller pairs in this embodiment, of the two roller pairs disposed adjacent to each other with respect to the sheet feeding direction, an upstream-side roller pair is a first roller pair in this embodiment, and a downstream-side roller pair is a second roller pair in this embodiment.

Further, an upstream-side end portion of the lower guide 202B with respect to the sheet feeding direction has a shape including an inclined surface 202C, as a first guiding surface in this embodiment, which is inclined so that an upstream portion of the feeding passage 200B expands toward the feeding passage 200A (FIGS. 2 to 6). By such a shape, as shown in FIG. 6B, a surface 202D of the lower guide 202B provides a positional relationship such that the surface 202D is spaced from a phantom surface (plane) IS1 which is a contact surface (plane) extended from an end portion of the lower guide 201B of the first feeding unit 201 toward the free end portion 209A of the rib 209. A first phantom surface (plane) is the phantom surface (plane) IS1. The surface 202D of the lower guide 202B constitutes the first guiding surface in this embodiment in cooperation with the inclined surface 202C. By this, the sheet fed along the feeding passage 200A is guided along the free end portion 209A of the rib 209. However, the sheet contacts the inclined surface 202C in the case where the leading end of the sheet is bent due to an occurrence of a curl or the like or in the case where a stepped portion is formed between the feeding passages 200A and 200B depending on an arrangement of the first feeding unit 201 and the second feeding unit 202.

That is, in this embodiment, the lower guide 202B made of the metal provides a positional relationship such that the lower guide 202B is contactable to the leading end between the upstream side end portion of the second feeding unit 202 and a section in which the ribs 209 are provided. For that reason, the leading end of the sheet is capable of being abutted against the inclined surface 202C and the surface 202D of the lower guide 202B, so that a degree of abrasion (wearing) of the ribs 209 caused by abutment of the leading end of the sheet against the ribs 209 can be reduced. A first surface in this embodiment is the lower guide 202B. Further, a first section in this embodiment is a section, of the lower guide 202B, from the upstream side end portion of the second feeding unit 202 to an upstream and of a most upstream rib 209 provided on the lower guide 202B. Further, a second section in this embodiment is a section downstream of the most upstream rib 209 provided on the lower guide 202B.

In this embodiment, the lower guide 202B of the second feeding unit 202 is provided with a plurality of the ribs 209 and 210, so that it is possible to suppress occurrence of the image defect and the improper feeding of the sheet caused due to stagnation of the water vapor in the feeding passage 200B. In addition, a liability such that the sheet contacts a fine object such as paper powder accumulated on the surface of the lower guide 202B by the ribs 209 and 210 becomes small, and therefore, the image defect of the sheet caused by the paper powder or the like can be suppressed.

Embodiment 2

Figure 7A:
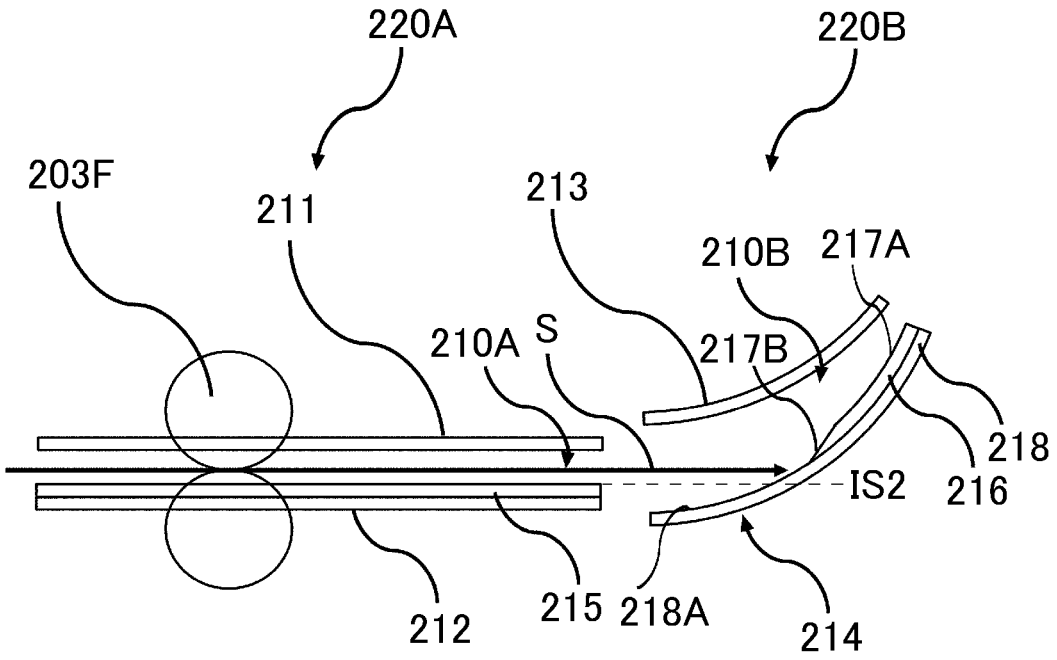
FIG. 7A is a sectional view of a feeding passage during sheet feeding in an embodiment 2.
Figure 7B:
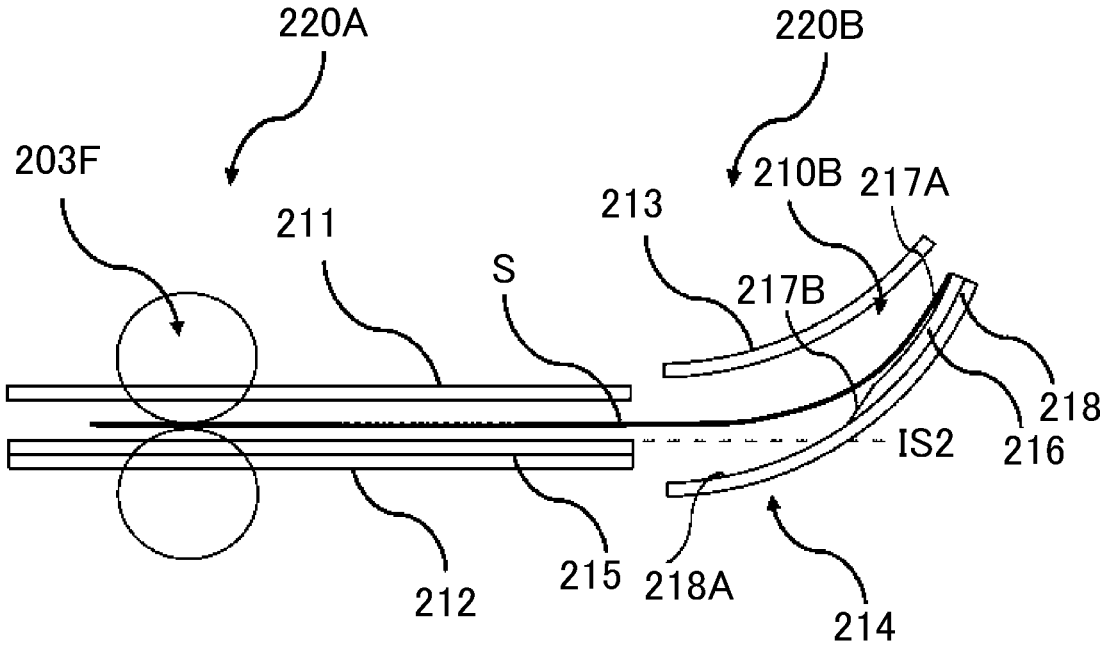
FIG. 7B is a sectional view of the feeding passage during the sheet feeding in the embodiment 2.
Figure 8:
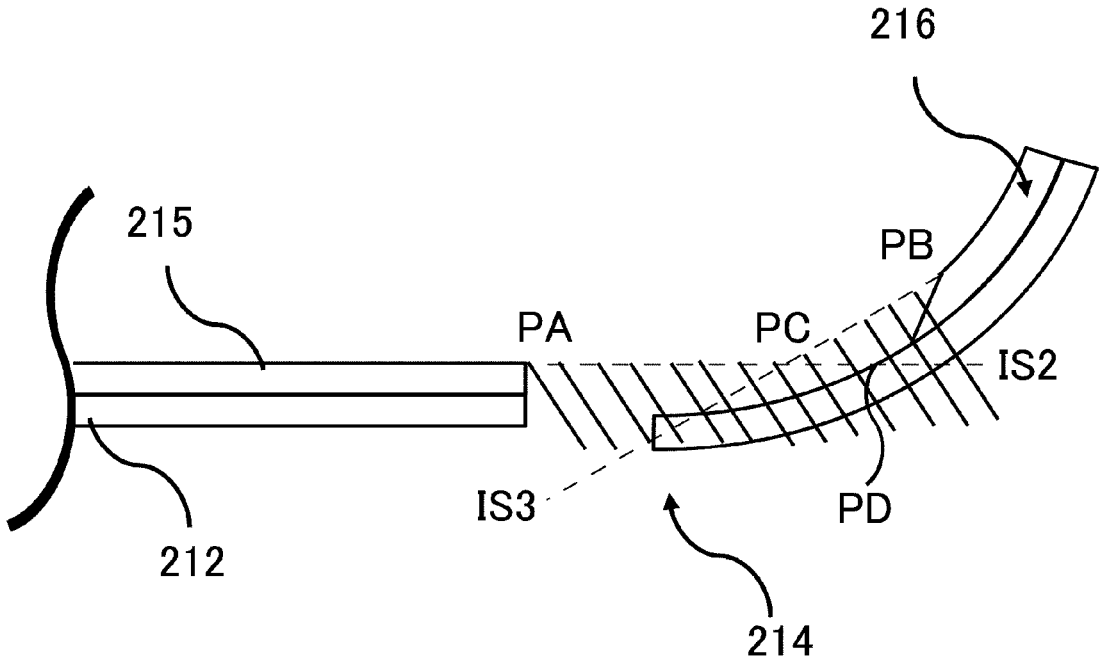
FIG. 8 is a sectional view of a feeding guide in the embodiment 1.

In the embodiment 1, the constitution in which the image defect and the improper feeding of the sheet fed between the two feeding units are suppressed was described. In an embodiment 2, a constitution in which the image defect and the improper feeding of the sheet when the sheet is fed in a curved state are suppressed will be described. Incidentally, a structure of a printer 100 in this embodiment is the same as the structure of the printer 100 in the embodiment 1, and therefore, redundant description will be omitted. FIGS. 7A and 7B are sectional views each showing a feeding guides 220A and 220B during sheet feeding in this embodiment. FIG. 8 is a sectional view showing the feeding guides 220A and 220B in this embodiment.

In this embodiment, the feeding guides 220A and 220B are provided so as to form a feeding passage such that a shape thereof changes from a substantially rectilinear shape capable of feeding the sheet horizontally to a curved shape capable of feeding the sheet in a curved state. The feeding passage such that the shape thereof changes from the substantially rectilinear shape to the curved shape refers to, for example, in FIG. 1, a feeding passage from the double-side feeding portion 200 toward the feeding portion 130, a feeding passage during reverse feeding of the sheet, and the like feeding passage. As shown in FIGS. 7A and 7B, the feeding guide 220A forms a feeding passage 210A having a substantially rectilinear shape, and the feeding guide 220B forms a feeding passage 210B having a curved shape. With respect to the sheet feeding direction, the feeding guide 220B is disposed downstream of and adjacent to the feeding guide 220A. In FIGS. 7A and 7B, the feeding guides 220A and 220B are illustrated as separate members, but may also be formed integrally with each other. In this embodiment, a first guiding portion is the feeding guide 220A, and a second guiding portion is the feeding guide 220B. Further, in this embodiment, a first feeding passage is the feeding passage 210A, and a second feeding passage is the feeding passage 210B.

As shown in FIG. 7A, the feeding guide 220A includes a feeding roller pair 203F, an upper guide 211, and a lower guide 212. In the feeding guide 220A, the sheet is fed along a feeding surface 215 of the lower guide 212. In this embodiment, a first surface is the feeding surface 215. The feeding guide 220B includes an upper guide 213 and a lower guide 214. The lower guide 214 is constituted by a first member 218 which is high in thermal conductivity and hardness and which is made of metal and a second member 216 made of a resin material such as polyacetal (POM) lower in thermal conductivity and hardness than the first member 218. As shown in FIGS. 7A and 7B, the second member 216 is disposed downstream of the first member 218 in the feeding passage 210B and has a shape such that the second member 216 projects toward the feeding passage 210B than a surface 218A of the first member 218 is. Further, the first member 218 is disposed in the lower guide 214 so as to be contactable to the sheet between an upstream end portion of the feeding passage 210B to an upstream end portion of the second member 216. A first section in this embodiment is a section from an upstream-side end portion of the lower guide 214 to an upstream end of the second member 216 provided as a part of the lower guide 214. Further, a second section in this embodiment is a section downstream of the upstream end of the second member 216 of the lower guide 214. Further, a projected portion in this embodiment is the second member 216.

The second member 216 may be provided as a plurality of ribs on the surface 218A, and may also be formed in a shape such that the second member 216 is bonded to a part of the surface 218*a* so as to form a curved surface. The second member 216 is in a position projected and spaced from the surface 218A, and includes a first portion 217A to which the sheet is contactable and a second portion 217B inclined from an upstream end portion of the first portion 217A toward the surface 218A. In this embodiment, a contact surface portion is the first portion 217A, and an inclined surface portion is the second portion 217B. Further, a second guiding surface in this embodiment is constituted by the first portion 217A and the second portion 217B. A projecting direction of the second member 216 is a direction from the surface 218A of the first member 218 toward the feeding passage 210B.

Next, a positional relationship of the leading end of the sheet S when the sheet S is fed from the feeding guide 220A to the feeding guide 220B. The leading end of the sheet S fed along the feeding guide 220A is d in guided in contact with the surface 218A of the first member 218 in a state in which the sheet S is fed along the feeding surface 215 (FIG. 7A). A first guiding surface in this embodiment is the surface 218A. A feeding resistance between the sheet S and the lower guide 214 becomes largest when the leading end of the sheet S contacts the surface of the lower guide 214. In this embodiment, a positional relationship such that with respect to the sheet feeding direction, a phantom surface (plane) IS2 extended from the feeding surface 215 of the first feeding guide 220A crosses the first member 218 of the lower guide 214 of the second feeding guide 220B is formed. In other words, with respect to the sheet feeding direction, the upstream end portion of the second member 216 which is a member, made of a resin material, of the feeding guide 220B is disposed downstream of a position (position PD in FIG. 8) where the phantom surface IS2 as a second phantom contact surface (plane) crosses the surface 218A of the first member 218. By such an arrangement of the first member 218, in this embodiment, it becomes possible to suppress that the leading end of the sheet S abuts against the second member 216 and thus the second member is abraded and worn.

Further, the leading end of the sheet S when the sheet S is fed from the feeding guide 220A to the feeding guide 220B is guided along the second portion 217B of the second member 216 and delivered from the second portion 217B to the first portion 217A. When the leading end of the sheet S reaches the first portion 217A in a state in which the leading end of the sheet S contacts the feeding surface 215, the sheet S is fed along the lower guide 214 in a state in which the S is spaced from the surface 218A of the first member 218 (FIG. 7B). Here, with respect to the sheet feeding direction, a contact surface (plane) including a tangential direction at a position PB of the upstream end portion of the first portion 217A of the second member 216 is referred to as a phantom surface (plane) IS3. Further, a crossing position of crossing lines where the phantom surface IS3 and the phantom surface IS2 extended from an end portion PA of the feeding surface 215 of the first feeding guide 220A cross each other is referred to as a position PC (FIG. 8). The position PC is in a position spaced from the surface 218A of the first member 218 with a predetermined distance (for example, a distance corresponding to a thickness of the second member 216). By this, in the feeding passage 210B, when the leading end of the sheet S reaches the first portion 217A in the state in which the sheet leading end contacts the feeding surface 215, the sheet is fed in a state in which the sheet leading end is spaced from the surface 218A of the first member 218. The phantom surface IS3 is a first phantom surface in this embodiment. For that reason, even in the case where dew condensation occurs in the feeding passage 210B, the water content adheres to only the leading end of the sheet S, and therefore, it becomes possible to suppress adhesion of the water content to an image region of the sheet S. Further, it also becomes possible to suppress the influence of the paper powder or the like, accumulated on the lower guide 214, on the image region of the sheet S.

Other Embodiments

In this embodiment, the printer 100 in which the engine portion 121 and the fixing portion 160 are disposed in a single casing 101 was described. In addition thereto, for example, the constitutions of the embodiments 1 and 2 can also be applied to a printing system as an example of an image forming apparatus in which an engine portion and a fixing portion are disposed in different casings. Further, as an image forming method, in addition to the electrophotographic type (method) described in the embodiments 1 and 2, it is possible to use an image forming method capable of forming an image by applying energy to an ultraviolet curable resin material or the like. Further, the present invention is also applicable to a guiding member forming a sheet feeding passage provided in an automatic original feeder (feeding device) for reading a sheet by successively feeding sheets from a sheet bundle stacked on a tray.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-095409 filed on Jun. 1, 2020, which is hereby incorporated by reference herein in its entirety.

What is claimed is:

1. An image forming apparatus comprising:

fixing means configured to heat and fix a toner image on a sheet;

a first guiding unit having a first surface forming a first feeding passage along which the sheet on which the toner image is fixed by said fixing means is fed; and a second guiding unit provided downstream of and adjacent to said first guiding unit with respect to a sheet feeding direction and configured to form a second feeding passage along which the sheet fed along said first feeding passage is fed, wherein said second guiding unit includes a first member which is made of metal and which has a first guiding surface on which a leading end of the sheet is guided in a first section including an upstream end portion of said second feeding passage with respect to the sheet feeding direction, and includes a second member which is made of a resin material and which has a second guiding surface on which the sheet is guided in a second section downstream of the first section in said second feeding passage with respect to the sheet feeding direction, and wherein the first guiding surface is spaced from a first phantom contact surface which is a contact surface extending from an end portion of the first surface and which contacts the second guiding surface.

2. An image forming apparatus according to claim 1, wherein the first guiding surface is inclined so that an upstream portion of said second feeding passage with respect to the sheet feeding direction expand toward said first feeding passage of said first guiding unit, and the leading end of the sheet fed along said first feeding passage contacts the first guiding surface.

3. An image forming apparatus according to claim 1, wherein said first member is a plate like member defining said second feeding passage in the first section and the second section, and wherein said second member includes a plurality of projected portions projecting toward said second feeding passage than a surface of said first member on a second feeding passage side, and forms the second guiding surface by free end portions of the projected portions.

4. An image forming apparatus according to claim 3, wherein said second guiding unit includes a roller pair for nipping and feeding the sheet at a central portion thereof with respect to a widthwise direction perpendicular to the sheet feeding direction, and wherein the projected portions are disposed outside said roller pair with respect to the widthwise direction so as to extend outward relative to the sheet feeding direction.

5. An image forming apparatus according to claim 4, wherein said roller pair is a first roller pair, wherein said second guiding unit includes a second roller pair, provided downstream of said first roller pair with respect to the sheet feeding direction, for nipping and feeding the sheet, wherein the projected portions are a plurality of first projected portions, and wherein said second member is provided between said first roller pair and said second roller pair with respect to the sheet feeding direction and includes a plurality of second projected portions projecting toward said second feeding passage than the surface of said first member on the second feeding passage side.

6. An image forming apparatus according to claim 5, wherein the first projected portions are disposed so as to extend in a state in which the first projected portions are inclined outward from a feeding center with respect to the widthwise direction toward a downstream portion thereof with respect to the sheet feeding direction, and wherein the second projected portions are disposed at the feeding center with respect to the widthwise direction so as to extend in the sheet feeding direction.

7. An image forming apparatus comprising:

fixing means configured to heat and fix a toner image on a sheet;

a first guiding portion having a first surface forming a first feeding passage along which the sheet on which the toner image is fixed by said fixing means is fed; and a second guiding portion provided downstream of and adjacent to said first guiding portion with respect to a sheet feeding direction and configured to have a curved shape so as to form a second feeding passage along which the sheet fed along said first feeding passage is fed, wherein said second guiding portion includes a first member which is made of metal and which has a first guiding surface on which a leading end of the sheet is guided in a first section including an upstream end portion of said second feeding passage with respect to the sheet feeding direction, and includes a second member which is made of a resin material and which has a second guiding surface on which the sheet is guided in a second section downstream of the first section in said second feeding passage with respect to the sheet feeding direction, and wherein an upstream end portion of the second guiding surface with respect to the sheet feeding direction is positioned downstream, with respect to the sheet feeding direction, of a position where a first phantom surface extended from the first surface and the first guiding surface cross each other.

8. An image forming apparatus according to claim 7, wherein said second member includes a plurality of projected portions projecting toward said second feeding passage than a surface of said first member on a second feeding passage side, and wherein the second guiding surface contacts top portions of the projected portions with respect to a projection direction, and includes a contact surface portion spaced from the surface of said first member on the second feeding passage side and an inclined surface portion inclined from an upstream end portion of said contact surface portion with respect to the sheet feeding direction toward the surface of said first member on the second feeding passage side.

9. An image forming apparatus according to claim 8, wherein a crossing position of a crossing line where the first phantom surface and a second phantom surface which is a contact surface including a tangential line direction at the upstream end portion with respect to the sheet feeding direction cross each other is spaced from the first guiding surface with a predetermined distance.

10. An image forming apparatus according to claim 7, wherein the first phantom surface is a surface extended from a downstream end of the first surface along the first surface.

* * * * *